US008853139B2

(12) United States Patent
Iwasaki et al.

(10) Patent No.: US 8,853,139 B2
(45) Date of Patent: Oct. 7, 2014

(54) DETERGENT-DISPERSANT, ADDITIVE COMPOSITION FOR LUBRICANT, AND LUBRICANT COMPOSITION

(71) Applicants: Junya Iwasaki, Sodegaura (JP); Izumi Terada, Sodegaura (JP); Hiroaki Koshima, Sodegaura (JP)

(72) Inventors: Junya Iwasaki, Sodegaura (JP); Izumi Terada, Sodegaura (JP); Hiroaki Koshima, Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 13/656,031

(22) Filed: Oct. 19, 2012

(65) Prior Publication Data

US 2013/0045904 A1 Feb. 21, 2013

Related U.S. Application Data

(63) Continuation of application No. PCT/JP2008/060594, filed on Jun. 10, 2008.

(30) Foreign Application Priority Data

Jun. 11, 2007 (JP) ..... 2007-154391

(51) Int. Cl.

| | |
|---|---|
| ***C10M 139/00*** | (2006.01) |
| ***C10M 133/44*** | (2006.01) |
| ***C07D 233/14*** | (2006.01) |
| ***C10M 135/32*** | (2006.01) |
| ***C07D 345/00*** | (2006.01) |
| ***C07D 403/02*** | (2006.01) |
| ***C07D 233/00*** | (2006.01) |
| ***C10M 135/34*** | (2006.01) |
| ***C10M 133/46*** | (2006.01) |
| ***C10M 133/48*** | (2006.01) |
| ***C10M 129/20*** | (2006.01) |
| ***C10M 133/42*** | (2006.01) |
| ***C10M 133/38*** | (2006.01) |
| ***C10M 135/36*** | (2006.01) |
| ***C10M 133/40*** | (2006.01) |

(52) U.S. Cl.

CPC ..... *C10M 133/38* (2013.01); *C10M 2219/104* (2013.01); *C10N 2230/08* (2013.01); *C10M 135/34* (2013.01); *C10M 133/46* (2013.01); *C10M 2215/22* (2013.01); *C10M 133/44* (2013.01); *C10M 2219/102* (2013.01); *C10M 133/48* (2013.01); *C10M 129/20* (2013.01); *C10N 2230/04* (2013.01); *C10M 2219/106* (2013.01); *C10M 2215/225* (2013.01); *C10M 2215/221* (2013.01); *C10M 133/42* (2013.01); *C10M 2207/044* (2013.01); *C10N 2240/10* (2013.01); *C10M 135/36* (2013.01); *C10M 2215/224* (2013.01); *C10M 2215/223* (2013.01); *C10M 133/40* (2013.01); *C10M 2215/222* (2013.01)

USPC ..... 508/190; 508/269; 508/279; 508/283; 540/1; 548/306.1; 548/311.4; 548/335.1

(58) Field of Classification Search

USPC ..... 508/190, 279, 269, 283; 540/1; 548/306.1, 311.4, 335.1

See application file for complete search history.

(56) References Cited

U.S. PATENT DOCUMENTS

| | | | | |
|---|---|---|---|---|
| 2,297,760 | A * | 10/1942 | Graenacher et al. | 548/304.4 |
| 2,988,478 | A * | 6/1961 | Gordon | 514/183 |
| 3,853,907 | A * | 12/1974 | Edwards | 548/313.7 |
| 4,637,886 | A | 1/1987 | Brois et al. | |
| 4,880,923 | A | 11/1989 | Brois et al. | |
| 5,162,526 | A | 11/1992 | Brois et al. | |
| 5,324,334 | A | 6/1994 | Brois et al. | |
| 5,391,605 | A | 2/1995 | Andres et al. | |
| 5,849,675 | A | 12/1998 | Brown et al. | |
| 6,187,722 | B1 | 2/2001 | Rowland et al. | |
| 6,566,311 | B1 | 5/2003 | Nalesnik | |
| 2004/0266633 | A1 | 12/2004 | Negoro et al. | |
| 2005/0172543 | A1 | 8/2005 | Muir | |

FOREIGN PATENT DOCUMENTS

| | | |
|---|---|---|
| EP | 0358377 | 3/1990 |
| JP | 64 29497 | 1/1989 |
| JP | 6 100881 | 4/1994 |
| JP | 6 157471 | 6/1994 |
| JP | 06157471 A * | 6/1994 |
| JP | 6 239867 | 8/1994 |
| JP | 8 165483 | 6/1996 |
| JP | 10 298574 | 11/1998 |
| JP | 2003 292982 | 10/2003 |
| JP | 2004 315703 | 11/2004 |
| JP | 2004 331950 | 11/2004 |
| JP | 2005 511817 | 4/2005 |
| JP | 2005 524762 | 8/2005 |
| JP | 2005 263671 | 9/2005 |
| JP | 2006 117734 | 5/2006 |
| JP | 2008 115267 | 5/2008 |
| WO | 00 40678 | 7/2000 |
| WO | 2005 073352 | 8/2005 |
| WO | 2005 080305 | 9/2005 |

OTHER PUBLICATIONS

Official Action issued Jan. 6, 2014, in CN Patent Application No. 201310058584.3.

* cited by examiner

*Primary Examiner* — Vishal Vasisth

(74) *Attorney, Agent, or Firm* — Oblon, Spivak, McClelland, Maier & Neustadt, L.L.P.

(57) ABSTRACT

Provided is a detergent-dispersant for a lubricant having excellent detergency and dispersibility effects. Specifically provided are: a detergent-dispersant including a heterocyclic compound having a heterocyclic skeleton derived from a compound selected from the group consisting of pyridines, pyrroles, pyrimidines, pyrazoles, pyridazines, imidazoles, pyrazines, triazines, triazoles, tetrazoles, oxazoles, oxadiazoles, thiazoles, thiadiazoles, furans, dioxanes, pyrans, and thiophenes; and an additive composition for a lubricant and a lubricant composition, each containing the detergent-dispersant.

6 Claims, No Drawings

DETERGENT-DISPERSANT, ADDITIVE COMPOSITION FOR LUBRICANT, AND LUBRICANT COMPOSITION

This application is a continuation of PCT/JP08/060594 filed Jun. 10, 2008 and claims the benefit of JP 2007-154391 filed Jun. 11, 2007. Also, this application is a continuation of application Ser. No. 12/602,499 filed Dec. 1, 2009, now abandoned.

TECHNICAL FIELD

The present invention relates to a detergent-dispersant and a lubricant composition containing the detergent-dispersant. More specifically, the present invention relates to an ashless detergent-dispersant, an additive composition for a lubricant, and to a lubricant composition containing the detergent-dispersant, which are excellent in high temperature stability, high temperature detergency, and in base value-maintainable property, and has fine particle-dispersibility.

BACKGROUND ART

In general, as conventional ashless detergent-dispersants, there have been used a succinimide-based detergent-dispersant, a hydroxybenzylamine-based detergent-dispersant, and the like. With their remarkable actions of dispersing fine particles being highly valued, the ashless detergent-dispersants are extensively used as lubricant additives for a gasoline engine oil, a diesel engine oil, a two-cycle engine oil, and the like. Further, those detergent-dispersants are each regarded as one of very important additives for lubricants, because the detergent-dispersants also have synergistic effects with zinc dialkyl dithiophosphate or a metal-type detergent-dispersant. However, it has often been pointed out that the stability at high temperature and the detergency at high temperature are insufficient.

In general, the conventional ashless detergent-dispersants including a succinimide-based detergent-dispersant and a hydroxybenzylamine-based detergent-dispersant have been insufficient in detergency and stability at high temperature.

Examples of the application of a heterocyclic compound to a lubricant are described in the following patent documents.

In Patent Document 1, there is used benzotriazole as a corrosion inhibitor. Patent Document 2 describes an application of a triazole derivative to a refrigerator oil composition and makes a point in the effect of abrasion resistance. In Patent Document 3, there is used an imidazole fluorine derivative as a surface treating agent. Patent Document 4 describes that polybenzoimidazole is used as a polymer containing an internal lubricant. In Patent Document 5, there is a description on a fluid composition for active suspension containing thiadiazole or benzotriazole and having excellent abrasion resistance. Patent Document 6 describes that a triazine derivative is used as a dispersant for lubricants and fuels. In Patent Document 7, there is a description on indazole thione additives for lubricants. In Patent Document 8, there is a description on a fluid having low traction property which has a triazine structure. Still further, in Patent Document 9, there is a description on a lubricant composition including a triazine derivative.

However, any of the above Patent documents neither describes each of their products as an ashless detergent-dispersant, nor does it particularly make a point in a detergency of their products.

Patent Document 1: JP 01-29497 A
Patent Document 2: JP 06-100881 A

Patent Document 3: JP 06-157471 A
Patent Document 4: JP 07-506860 A
Patent Document 5: JP 08-165483 A
Patent Document 6: JP 2002-534436 A
Patent Document 7: JP 2003-505577 A
Patent Document 8: JP 2004-315703 A
Patent Document 9: JP 2004-331950 A

DISCLOSURE OF THE INVENTION

Problem to be Solved by the Invention

It is an object of the present invention to provide a heterocyclic compound useful as an ashless detergent-dispersant, an additive composition for a lubricant, and a lubricant composition containing the detergent-dispersant which are excellent in high temperature stability, high temperature detergency, and in base value-maintainable property, and has excellent fine particle-dispersibility.

Means for Solving the Problem

In view of the above-mentioned circumstances of the prior art, the inventors of the present invention have conducted intensive studies in order to develop a lubricant composition having improved detergency and dispersibility. As a result, the inventors have found that a heterocyclic compound having a specific chemical structure may exhibit excellent properties as an ashless detergent-dispersant and may impart high temperature stability and the like to a lubricant for an internal combustion engine and a transmission engine of a driving system. Thus, the present invention has been completed.

That is, the present invention provides the following Items (1) to (7):

(1) A detergent-dispersant comprising a heterocyclic compound which is represented by the following general formula (I), and which may have a double bond in a cyclic moiety:

(I

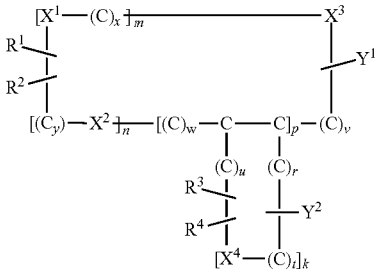

where: $X^1$, $X^2$, $X^3$, and $X^4$ each independently represent "N" or "NH", "O", or "S"; "p" represents 0 or 1, "x" and "y" each independently represent an integer of 0 to 2, "u" and "r" each independently represent an integer of 0 to 4, "t" and "w" each independently represent an integer of 0 to 3, "v" represents an integer of 0 to 5 in a case where "p" represents 0 and "v" represents an integer of 0 to 3 in a case where "p" represents 1, "n" and "m" each independently represent an integer of 0 to 3, "k" represents an integer of 0 to 3, and "x", "y", "n", "m", and "v" do not each represent 0 at the same time in a case where "p" represents 0; $R^1$ to $R^4$ each independently represent a hydrogen atom or a hydrocarbon group which may have at least one kind of substituent selected from the group consisting of an amino group, an amide group, an ether group, and a carboxyl group, and which has a total carbon number of 10 to 200, the hydrogen atom and the hydrocarbon group being bonded to a carbon atom, $R^1$ and $R^2$ do not each represent a hydrogen atom at the same time in a case where "p" represents 0, and $R^1$ to $R^4$ do not each represent a hydrogen atom at the same time in a case where "p" represents 1; and $Y^1$ and $Y^2$ each independently represent a hydrogen atom, a halogen atom, a functional group selected from the group consisting of an amino group, an amide group, a hydroxyl group, a carbonyl group, an aldehyde group, a carboxyl group, an ester group, and an ether group, or a hydrocarbon group which may have at least one kind of functional group selected from the group consisting of the above functional groups and has a total carbon number of 1 to 30;

(2) A detergent-dispersant according to Item (1), in which: p in the general formula (I) represents 1; and $X^1$, $X^2$, $X^3$, and $X^4$ in the general formula (I) each independently represent "N" or "NH";

(3) A detergent-dispersant according to Item (1), in which the general formula (I) includes a heterocyclic skeleton derived from a compound selected from the group consisting of pyridines, pyrroles, pyrimidines, pyrazoles, pyridazines, imidazoles, pyrazines, triazines, triazoles, tetrazoles, oxazoles, oxadiazoles, thiazoles, thiadiazoles, furans, dioxanes, pyrans, and thiophenes;

(4) A detergent-dispersant according to Item (1), in which the heterocyclic compound includes a boride thereof;

(5) An additive composition for a lubricant containing the detergent-dispersant according to Item (1);

(6) A lubricant composition containing the detergent-dispersant according to Item (1); and (7) A lubricant composition according to Item (6), which is a lubricant composition for an internal combustion engine.

Effects by the Invention

By using the lubricant composition containing the detergent-dispersant of the present invention, the heterocyclic compound exhibits excellent high temperature stability, high temperature detergency, base value-maintainable property, and fine particle-dispersibility in, for example, a gasoline engine oil, a diesel engine oil, a two-cycle engine oil, and the like for an internal combustion engine.

BEST MODE FOR CARRYING OUT THE INVENTION

Hereinafter, the present invention is described in detail.

A detergent-dispersant of the present invention is comprised a heterocyclic compound represented by the general formula (I).

In the general formula (I), (1) in the case where "p" represents 0:

$X^1$, $X^2$, and $X^3$ each independently represent "N" or "NH", O, or "S"; "x" and "y" each independently represent an integer of 0 to 2, "v" represents an integer of 0 to 5, "n" and "m" each independently represent an integer of 0 to 3, and "x", "y", "n", "m", and "v" do not each represent 0 at the same time; and $R^1$ and $R^2$ each independently represent a hydrogen atom or a hydrocarbon group which may have at least one kind of substituent selected from the group consisting of an amino group, an amide group, an ether group, and a carboxyl group, and which has a total carbon number of 10 to 200, the hydrogen atom and the hydrocarbon group being bonded to a carbon atom, and $R^1$ and $R^2$ do not each represent a hydrogen atom at the same time.

In the general formula (I), (2) in the case where "p" represents 1:

$X^1$, $X^2$, $X^3$, and $X^4$ each independently represent "N" or "NH", "O", or "S"; "x" and "y" each independently represent an integer of 0 to 2, "u" and "r" each independently represent an integer of 0 to 4, "t" and "w" each independently represent an integer of 0 to 3, "v" represents an integer of 0 to 3, "n" and "m" each independently represent an integer of 0 to 3, and "k" represents an integer of 0 to 3; and $R^1$ to $R^4$ each independently represent a hydrogen atom or a hydrocarbon group which may have at least one kind of substituent selected from the group consisting of an amino group, an amide group, an ether group, and a carboxyl group, and has a total carbon number of 10 to 200, the hydrogen atom and the hydrocarbon group being bonded to a carbon atom, and $R^1$ to $R^4$ do not each represent a hydrogen atom at the same.

$Y^1$ and $Y^2$ each independently represent a hydrogen atom, a halogen atom, a functional group selected from the group consisting of an amino group, an amide group, a hydroxyl group, a carbonyl group, an aldehyde group, a carboxyl group, an ester group, and an ether group, or a hydrocarbon group which may have at least one kind of functional group selected from the group consisting of the above functional groups and has a total carbon number of 1 to 30.

In the hydrocarbon group of the detergent-dispersant of the present invention, which is comprised the heterocyclic compound represented by the general formula (I), when the carbon number is 10 or more, the solubility with respect to a base oil for a lubricant is sufficient, and when the carbon number is 200 or less, the hydrocarbon group becomes a compound having excellent detergency and dispersibility and in addition, high temperature stability, base value-maintainable property, and the like are ensured.

$R^1$ to $R^4$ preferably represent a hydrogen atom or a hydrocarbon group having a carbon number of 12 to 150. Specific examples thereof include hydrocarbon groups such as a dodecyl, dodecenyl, tetradecene, tetradecenyl, hexadecene, hexadecenyl, octadecyl, octadecenyl, oleyl, stearyl, isostearyl, decene trimer, or a polybutene group, each of which may be linear or branched.

The heterocyclic compound represented by the general formula (I) is, for example, a reaction product obtained by allowing to react one of (a) which is a compound having pyridine, pyrrole, pyrimidine, pyrazole, pyridazine, imidazole, pyrazine, triazine, triazole, benzotriazole, tetrazole, oxazole, oxadiazole, thiazole, thiadiazole, furane, or thiophene as a basic skeleton, or derivatives thereof, the compound or the derivatives forming the basic skeleton of a heterocyclic ring, with one of (b) which is a halogen compound having an alkyl group, an alkenyl group, or a cycloalkyl group having a carbon number of 10 to 200, an amine compound, alcohols, an epoxy compound, or a compound having a carboxyl group, at a molar ratio (a):(b) of 1:5 to 5:1 and preferably 1:2 to 2:1.

When the molar ratio (a):(b) is 1:5 or more to 5:1 or less, an active ingredient amount of the detergent-dispersant of the present invention is prevented from becoming small, and the necessity of using a large amount of the detergent-dispersant in order to exhibit high temperature stability, high temperature detergency, and base value-maintainable property is prevented from occurring.

A reaction between (a) and (b) is performed at room temperature to 250° C. and preferably at 50 to 220° C. The reaction may be performed without a catalyst or under the presence of the catalyst. Further, in performing the reaction, there may be used a solvent, for example, an organic solvent such as hexane, toluene, xylene, THF, or DMF.

In the heterocyclic compound represented by the general formula (I), the basic skeleton of a heterocyclic ring is a saturated or unsaturated compound in which one ring has a total number of nitrogen atom and/or oxygen atom and/or sulfur atom of 1 to 4. Examples of the cyclic compound include pyridine, pyrrole, pyrimidine, pyrazole, pyridazine, imidazole, pyrazine, triazine, triazole, tetrazole, oxazole, oxadiazole, thiazole, thiadiazole, furane, thiophene, and derivatives thereof. Preferred are pyridine, pyrrole, pyrimidine, pyrazole, pyridazine, imidazole, pyrazine, triazole, tetrazole, oxadiazole, thiazole, and thiadiazole, and more preferred are pyridine, pyrimidine, pyrrole, pyrazole, imidazole, triazole, and derivatives thereof. Those may be the monocyclic compounds described above or polycyclic compounds such as indole, indazole, benzotriazole, benzoimidazole, purine, quinoline, isoquinoline, naphthyridine, carbazole, and naphthoimidazole. Further, examples of the cyclic compound may include a compound in which a hydrocarbon group or an amine, an amide, an alcohol, a ketone, an aldehyde, a carboxylic acid, an ester, an ether, a halogen, and a hydrocarbon compound including those may be added to the heterocyclic compound as a functional group.

Examples of the functional group which may be added to the heterocyclic compound include a group such as methyl, ethyl, propyl, butyl, pentyl, hexyl, amine, amide, alcohol, methylcarboxy, ethylcarboxy, aldehyde, carboxylic acid, acetoxyl, propoxyl, butyroylxyl, halogen, ethyloxy, propyloxy, ethylamine, methylamine, dimethylamine, diethylamine, polyethylene polyamine, diethylene triamine, triethylene tetraamine, tetraethylene pentamine, and aminoethyl piperazine.

Examples of compound (b) include bromine-based compounds such as 2-decyl-1-bromotetradecane, 2-butyl-1-bromooctane, 2-pentyl-1-bromononane, 2-hexyl-1-bromodecane, 2-heptyl-1-bromoundecane, 2-octyl-1-bromododecane, 2-nonyl-1-bromotridecane, 2,4-dioctyl-1-bromotetradecane, bromopolybutene, bromododecane, bromotetradecane, bromohexadecane, bromooctadecane, bromoeicosane, bromodocosane, bromotetracosane, bromoisostearyl, chlorine-based compounds such as 2-decyl-1-chlorotetradecane, 2-butyl-1-chlorooctane, 2,4-dioctyl-1-chlorotetradecane chloropolybutane, chlorododecane, and chlorotetracosane; iodine-based compounds such as 2-decyl-1-iodotetradecane, 2-butyl-1-iodooctane, 2,4-dioctyl-1-iodotetradecane, iodopolybutene, iodododecane, andiodotetracosane; epoxy compounds such as 2-decyl-1,2-epoxytetradecane, 2-butyl-1,2-epoxyoctane, 2,4-dioctyl-1,2-epoxytetradecane, polybuteneepoxide, 1,2-epoxydodecane, and 1,2-epoxytetracosane; amine compounds such as 2-decyl-tetradecylamine, 2-butyl-octylamine, 2,4-dioctyl-1-tetradecylamine, polybutenylamine, dodecylamine, and tetracosylamine; alcohols such as 2-decyl-tetradecyl alcohol, 2-butyl-octyl alcohol, 2,4-dioctyl-1-tetradecyl alcohol, polybutenyl alcohol, dodecyl alcohol, and tetracosyl alcohol; and compounds having a carboxyl group such as 2-decyl-tetradecanoic acid, 2-butyl-octanoic acid, 2,4-dioctyl-1-tetradecanoic acid, polybutenyl carboxylic acid, dodecanoic acid, and tetracosanic acid. One kind of those may be used alone or two or more kinds thereof may be used as a mixture.

In the heterocyclic compound represented by the general formula (I), acyclic structure part in the case where "p" represents 0 or two cyclic structure parts in the case where "p" represents 1 are derived from the compound (a). At least one of $R^1$ to $R^4$ is derived from the compound (b).

An additive composition for a lubricant can be obtained by mixing the heterocyclic compound represented by the general formula (I), which is obtained as described hereinabove and is the detergent-dispersant of the present invention, with various additives for lubricants. Further, a lubricant composition of the present invention can be obtained by using the detergent-dispersant alone or by mixing the additive composition for a lubricant with a base oil for a lubricant.

In addition, a boride of a heterocyclic compound, which is one embodiment of the detergent-dispersant of the present invention, is a reaction product obtained by allowing to react the heterocyclic compound obtained as described hereinabove with a boron-containing compound at a molar ratio of the heterocyclic compound to the boron-containing compound of 1:0.01 to 1:10 and more preferably 1:0.05 to 1:5. The reaction of the heterocyclic compound with the boron-containing compound is performed at 50 to 250° C. and preferably at 100 to 200° C. In performing the reaction, there may be used a solvent such as an organic solvent, e.g., a hydrocarbon oil. As the boron-containing compound, there may be used, for example, boron oxide, boron halide, boric acid, boric anhydride, and borate.

It should be noted that the boride of the heterocyclic compound obtained from the reaction has a structure in which boric acid is added or substituted for hydrogen in "NH", in the case where parts of $X^1$, $X^2$, $X^3$, $X^4$, $R^1$ to $R^4$, $Y^1$, and $Y^2$ in the general formula (I) each independently represent "N", "NH", or an amino group.

Examples of the various additives for lubricants include the following (preferred content and more preferred content in the total amount of the lubricant composition containing the base oil for a lubricant described later are described in parentheses).

The examples thereof include viscosity index improving agents of a polymethacrylate base and the like (preferably 1 to 12, more preferably 1 to 4% by mass), corrosion inhibitors of a benzotriazole base and the like (preferably 0.01 to 3, more preferably 0.01 to 1.5% by mass), antioxidants of alkylated diphenylamine and the like (preferably 0.01 to 5, more preferably 0.01 to 1.5% by mass), dispersants of polybutenylsuccinic imide and the like (preferably 0.1 to 10, more preferably 0.1 to 5% by mass), fluidity improving agents for a lubricant (preferably 0.01 to 2, more preferably 0.01 to 1.5% by mass), rust inhibitors of an alkenylsuccinic ester base and the like (preferably 0.01 to 6, more preferably 0.01 to 3% by mass), pour point depressants of polymethacrylate and the like (preferably 0.01 to 1.5, more preferably 0.01 to 0.5% by mass), defoaming agents (preferably 0.001 to 0.1, more preferably 0.001 to 0.01% by mass), anti-wear agents of a phosphorous ester base and the like (preferably 0.001 to 5, more preferably 0.001 to 1.5% by mass), seal swelling agents (preferably 0.1 to 8, more preferably 0.1 to 4% by mass), and friction controlling agents of fatty acid amide and the like (preferably 0.01 to 3, more preferably 0.01 to 1.5% by mass).

It should be noted that the detergent-dispersant of the present invention is used in a content of 0.01 to 15% by mass and preferably 0.05 to 10% by mass with respect to the total amount of the detergent-dispersant and the base oil for a lubricant. When the content is 0.01% by mass or more, cleaning and dispersing effects can be exhibited, and when the content is 15% by mass or less, an increase in the cost and a reduction in intrinsic characteristics endowed to the base oil for a lubricant can be avoided.

The base oil for a lubricant is not particularly limited, and various base oils for a mineral oil-based lubricant and synthetic oil-based lubricant can be used.

A specific example of the base oil for the mineral oil-based lubricant includes a hydrocarbon oil produced by refining a lubricant fraction, which is obtained by distilling crude oil under atmospheric pressure and reduced pressure, by appropriately combined refining treatments including solvent deasphalting, solvent extraction, hydro-cracking, solvent dewaxing, catalytic dewaxing, hydrorefining, washing with sulfuric acid, and clay treatment.

Herein, all of lubricants such as a paraffin-based mineral oil, a naphthene-based mineral oil, and an aromatic mineral oil can be used as the hydrocarbon oils.

Further, specific examples of a base oil for the synthetic oil-based lubricant which may be used include phenyl ether-based synthetic oils such as polyphenyl ether; polyolefin-based synthetic oils such as poly α-olefin (for example, a polybutene, 1-octene oligomer, a 1-decene oligomer, and hydrogenates thereof); benzene-based synthetic oils such as alkylbenzene; naphthalene-based synthetic oils such as alkylnaphthalene; ester-based synthetic oils such as diesters (for example, ditridecyl glutarate, di-2-ethylhexyl adipate, diisodecy adipate, ditridecy adipate, and di-2-ethylhexyl sepacate) and polyol esters (for example, trimethylolpropane carpriate, trimethylolpropane pelargonate, pentaerythritol 2-ethyl hexanoate, and pentaerythritol pelargonate); glycol-based synthetic oils such as polyoxyalkylene glycol; ether-based synthetic oils such as polyphenyl ether; and silicone-based synthetic oils such as silicone fluorinated oil. One kind of those may be used alone or two or more kinds thereof may be used as a mixture.

The product obtained by blending the detergent-dispersant of the present invention with a hydrocarbon oil, the lubricant fraction of a synthetic oil, or a mixture thereof can be used as a lubricant composition for an internal combustion engine (e.g., lubricant composition for a diesel engine), a gear oil, a bearing oil, a transmission oil, a shock absorber oil, and an industrial lubricant.

The product obtained by blending the heterocyclic compound with a hydrocarbon fuel oil is remarkable in cleaning and dispersing effects and can be used as a detergent for preventing a contaminant from being attached to a carburetor of an internal combustion engine and removing the attached matter.

EXAMPLES

Hereinafter, the present invention is described in further detail by way of examples and comparative examples, but the present invention is not limited to those examples.

Synthesis Example 1

Into a 500-ml flask there were charged 1.4 g (0.037 mol) of NaH (60%) and 20 ml of dimethylformamide (DMF). A solution in which 4.2 g (0.036 mol) of benzoimidazole were dissolved in 30 ml of DMF was added dropwise into the mixture, followed by a reaction at room temperature for 30 minutes. Subsequently, a solution in which 12.6 g (0.03 mol) of 2-decyl-1-bromotetradecane were dissolved in 15 ml of toluene was added dropwise into the reaction mixture, followed by a reaction at 100° C. for 7 hours. After the solvent has been distilled off, the residue was dissolved in 300 ml of hexane and washed with water. The organic layer was dried over magnesium sulfate and then hexane was distilled off. The residue was purified by a silica gel column chromatography, to thereby obtain 11.2 g of a heterocyclic compound [1-(2-decyl-1-tetradecanyl)-benzoimidazole], which was a target product.

This heterocyclic compound is referred to as "Detergent-dispersant 1".

Synthesis Example 2

A reaction was performed in the same manner as in Synthesis Example 1 except that 3.1 g (0.036 mol) of 5-aminotetrazole were used instead of benzoimidazole, to thereby obtain 6.3 g of a heterocyclic compound 1-(2-decyl-1-tetradecanyl)-5-aminotetrazole, which was a target product.

This heterocyclic compound is referred to as "Detergent-dispersant 2".

Synthesis Example 3

A reaction was performed in the same manner as in Synthesis Example 1 except that 2.5 g (0.036 mol) of imidazole were used instead of benzoimidazole, to thereby obtain 8.5 g of a heterocyclic compound [1-(2-decyl-1-tetradecanyl)-imidazole], which was a target product. This heterocyclic compound is referred to as "Detergent-dispersant 3".

Synthesis Example 4

A reaction was performed in the same manner as in Synthesis Example 1 except that 3.1 g (0.036 mol) of 2-aminobenzoimidazole were used instead of benzoimidazole, to thereby obtain 9.3 g of a heterocyclic compound [1-(2-decyl-1-tetradecanyl)-2-aminobenzoimidazole], which was a target product.

This heterocyclic compound is referred to as "Detergent-dispersant 4".

Reference Synthesis Example 5

A reaction was performed in the same manner as in Synthesis Example 1 except that 3.1 g (0.036 mol) of aminopyrazine were used instead of benzoimidazole, to thereby obtain 4.1 g of a heterocyclic compound, which was a target product. The structural formula of the heterocyclic compound is as follows. In the general formula (I), "p" represents 0, "m" represents 1, "v" represents 2, "x" represents 2, "n", "u", "r", and "k" each represent 0, $X^1$ and $X^3$ each represent "N", $R^1$ represents a 1-amino-2-decyltetradecyl group, $R^2$ represents a hydrogen atom, and $Y^1$ represents a hydrogen atom.

This heterocyclic compound is referred to as "Detergent-dispersant 5".

Reference Synthesis Example 6

Into a 1-1 flask there were charged 7.4 g (0.073 mol) of diisopropylamine ($iPr_2NH$) and 100 ml of tetrahydrofuran (THF). 44 ml of normal butyl lithium (nBuLi) (1.67 M hexane solution, 0.073 mol) were added dropwise into the mixture at −30° C., followed by stirring at the same temperature for 30 minutes. Subsequently, a solution of 5.1 g (0.055 mol) of γ-picoline in THF (80 ml) was added to the resultant, followed by stirring at −10° C. for 1 hour and 15 minutes.

Subsequently, a solution of 15.0 g (0.036 mol) of 2-decyl-1-bromotetradecane in THF (80 ml) was added dropwise into the resultant, and the mixture was allowed to react at room temperature for 1 hour and then at 40° C. for 4 hours.

After 300 ml of a saturated ammonium chloride aqueous solution were added to the reaction mixture, an organic layer was extracted from the mixture with 500 ml of hexane, and the organic layer was dried with magnesium sulfate. After the solvent has been distilled off, the residue was purified by a silica gel column chromatography, to thereby obtain 5.6 g of a heterocyclic compound, which was a target product. The structural formula of the heterocyclic compound is as follows. In the general formula (I), "p" represents 0, "v" represents 5, "m" "n", "u", "r", and "k" each represent 0, $X^3$ represents "N", $R^1$ represents a 3-decylpentadecyl group, $R^2$ represents a hydrogen atom, and $Y^1$ represents a hydrogen atom. This heterocyclic compound is referred to as "Detergent-dispersant 6".

Reference Synthesis Example 7

A reaction was performed in the same manner as in Synthesis Example 6 except that 5.1 g (0.055 mol) of α-picoline were used instead of γ-picoline, to thereby obtain 5.6 g of a heterocyclic compound, which was a target product. The structural formula of the heterocyclic compound is as follows. In the general formula (I), "p" represents 0, "v" represents 5, "m", "n", "u", "r", and "k" each represent 0, $X^3$ represents "N", $R^1$ represents a 3-decylpentadecyl group, $R^2$ represents a hydrogen atom, and $Y^1$ represents a hydrogen atom.

This heterocyclic compound is referred to as "Detergent-dispersant 7".

Synthesis Example 8

Into a 300-ml four-neck flask there were charged 93 g (0.22 mol) of 1-(2-decyl-1-tetradecanyl)-5-aminotetrazole synthesized in Synthesis Example 2 and 6.3 g (0.102 mol) of boric acid, and the mixture was allowed to react while stirring under nitrogen stream at 150° C. for 4 hours. The generated water was distilled off under reduced pressure at 150° C. and the reactant was filtered, to thereby obtain 96 g of a boride of a heterocyclic compound 1-(2-decyl-1-tetradecanyl)-5-(dihydroxyboranyl)aminotetrazole], which was a target product.

This boride is referred to as "Detergent-dispersant 8".

Synthesis Example 9

Into a 300-ml four-neck flask there were charged 105 g (0.22 mol) of 1-(2-decyl-1-tetradecanyl)-2-aminobenzoimidazole synthesized in Synthesis Example 4 and 6.3 g (0.102 mol) of boric acid, and the mixture was allowed to react under nitrogen stream at 150° C. for 4 hours.

The generated water was distilled off under reduced pressure at 150° C. and the reactant was filtered, to thereby obtain 108 g of a boride of a heterocyclic compound [(2-decyl-1-tetradecanyl)-2-(dihydroxyboranyl)aminobenzoimidazole], which was a target product.

This boride is referred to as "Detergent-dispersant 9".

Comparative Synthesis Example 1

Into a 2-liter autoclave there were charged 1,100 g of polybutene (Mw: 987), 6.4 g (0.021 mol) of cetyl bromide, and 115 g (1.2 mol) of maleic anhydride, and the mixture was subjected to nitrogen substitution and allowed to react at 240° C. for 5 hours. The temperature was lowered to 215° C., and unreacted maleic anhydride and cetyl bromide were distilled off under reduced pressure. The temperature was lowered to 140° C., and the resultant was filtered. The yield of the thus obtained polybutenylsuccinic anhydride was 1,100 g. Into a 2-liter separable flask there were charged 500 g of the obtained polybutenylsuccinic anhydride, 64 g (0.34 mol) of tetraethylenepentamine (TEPA), and 300 g of a mineral oil of 150 neutral fraction, and the mixture was allowed to react under nitrogen stream at 150° C. for 2 hours. The temperature was raised to 200° C., and unreacted TEPA and generated water were distilled off under reduced pressure. The temperature was lowered to 140° C., and the resultant was filtered. Thus, 790 g of a comparative heterocyclic compound (polybutenylsuccinicimide) were obtained. The structural formula of the comparative heterocyclic compound is as follows. In the general formula (I), $Y^1$ becomes an oxygen double bond. Accordingly, the comparative heterocyclic compound is not included in the scope of the detergent-dispersant of the present invention.

This comparative heterocyclic compound is referred to as "Comparative Detergent-dispersant 1".

Comparative Synthesis Example 2

A reaction was performed in the same manner as in Comparative Synthesis Example 1, except that 915 g of polybutene (Mw: 800) were used instead of polybutene (Mw: 987). The yield of the thus obtained polybutenylsuccinic anhydride was 940 g. Subsequently, a reaction was performed in the same manner as in Comparative Synthesis Example 1 by using 500 g of the obtained polybutenylsuccinic anhydride, 76 g (0.40 mol) of tetraethylenepentamine (TEPA), and 300 g of a mineral oil of 150 neutral fraction. Thus, 810 g of a comparative heterocyclic compound (polybutenylsuccinic imide) were obtained. The structural formula of the comparative heterocyclic compound is as follows. In the general formula (I), $Y^1$ becomes an oxygen double bond. Accordingly, the comparative heterocyclic compound is not included in the scope of the detergent-dispersant of the present invention.

This comparative heterocyclic compound is referred to as "Comparative Detergent-dispersant 2".

Comparative Synthesis Example 3

A reaction was performed in the same manner as in Comparative Synthesis Example 1, except that 890 g of polybutene (Mw: 445), 11 g (0.036 mol) of cetyl bromide, and 397 g (2.1 mol) of maleic anhydride were used instead of polybutene (Mw: 987). The yield of the thus obtained polybutenylsuccinic anhydride was 990 g. Subsequently, a reaction was performed in the same manner as in Comparative Synthesis Example 1 by using 500 g of the obtained polybutenylsuccinic anhydride, 88 g (0.60 mol) of triethylenetetramine (TETA), and 300 g of amineral oil of 150 neutral fraction. Thus, 820 g of a comparative heterocyclic compound (polybutenylsuccinicimide) were obtained. The structural formula of the comparative heterocyclic compound is as follows. In the general formula (I), $Y^1$ becomes an oxygen double bond. Accordingly, the comparative heterocyclic compound is not included in the scope of the detergent-dispersant of the present invention.

This comparative heterocyclic compound is referred to as "Comparative Detergent-dispersant 3".

Examples 1 to 9 and Comparative Examples 1 to 3

Lubricant compositions were each prepared by adding, to 90 parts by mass of a mineral oil of 500 neutral fraction, 10 parts by mass of one of "Detergent-dispersants 1 to 9" obtained in Synthesis Examples 1 to 9 and "Comparative Detergent-dispersants 1 to 3" obtained in Comparative Synthesis Examples 1 to 3.

The performances of those lubricant compositions were evaluated by a hot tube test under the following conditions. Table 1 shows the results.

[Hot Tube Test]

The lubricant composition and air were allowed to flow continuously at a rate of 0.3 ml/hr and a rate of 10 ml/min, respectively, for 16 hours through a glass tube which is kept at 250° C. and has an inner diameter of 2 mm. The lacquer adhered to the test tube was compared with a color sample and was evaluated into 11 grades, from 10 points in the case of colorless to 0 point in the case of black. At the same time, the mass of the lacquer adhered to the test tube was measured. The results show that the larger the grade becomes or the smaller the amount of the adhered lacquer becomes, the higher the performance of the lubricant composition is. The test was performed in accordance with JPI-5S-55-99.

[Base Value-maintainable Property Test]

The test oil obtained after the hot tube test described above was collected, and the base value was determined by a hydrochloric acid method in accordance with JIS K2501. The base value-maintainable property was evaluated by comparing abase value after the test (residual base value) to a base value before the test (initial base value) and expressing the result as a residual base value ratio (%) [residual base value ratio (%)=(residual base value/initial base value)×100]. The results show that the higher the residual base value ratio becomes, the higher the performance of the base value-maintainable property is.

TABLE 1

| | Used detergent-dispersant | Grade | Mass of adhered lacquer (mg) | Initial base value | Residual base value ratio (%) |
|---|---|---|---|---|---|
| Example 1 | Detergent-dispersant 1 | 10 | 0 | 0.42 | 223 |
| Example 2 | Detergent-dispersant 2 | 8 | 1.4 | 0.15 | 154 |
| Example 3 | Detergent-dispersant 3 | 9 | 2.4 | 8.42 | 57 |
| Example 4 | Detergent-dispersant 4 | 10 | 0 | 11.1 | 60 |
| Example 5 | Detergent-dispersant 5 | 6 | 2.6 | 1.3 | 21 |
| Example 6 | Detergent-dispersant 6 | 9 | 3.4 | 0.24 | 361 |
| Example 7 | Detergent-dispersant 7 | 8 | 5.6 | 0.14 | 340 |
| Example 8 | Detergent-dispersant 8 | 10 | 0 | 0.13 | 128 |
| Example 9 | Detergent-dispersant 9 | 10 | 0 | 10.0 | 72 |
| Comparative Example 1 | Comparative Detergent-dispersant 1 | 0 | 45 | 7.7 | 2 |
| Comparative Example 2 | Comparative Detergent-dispersant 2 | 0 | 48 | 8.5 | 1 |
| Comparative Example 3 | Comparative Detergent-dispersant 3 | 0 | 57 | 9.8 | 2 |

INDUSTRIAL APPLICABILITY

The product in which the detergent-dispersant of the present invention is blended in a mineral oil-based hydrocarbon oil, a synthetic lubricant base oil, or the mixture thereof has improved detergency and dispersibility and exerts excellent fuel consumption reduction effect in an internal combustion engine and a transmission engine of a driving system. In addition, the product is ashless, and hence is suitable as an environment-responsive detergent-dispersant.

The invention claimed is:

1. A method for producing a lubricant composition, which comprises:

(1) obtaining a reaction product by reacting one of a heterocyclic compound (a) with one of compound (b) at a molar ratio (a):(b) of 1:5 to 5:1; and (2) mixing the reaction product with a lubricant base oil, wherein the heterocyclic compound (a) is a 2-aminobenzoimidazole, the compound (b) is a 2-decyl-1-bromotetradecane and the reaction product is a 1-(2-decyl-1-tetradecanyl)-2-aminobenzoimidazole, wherein the heterocyclic compound (a) is a benzoimidazole, the compound (b) is a 2-decyl-1-bromotetradecane and the reaction product is a 1-(2-decyl-1-tetradecanyl)-benzoimidazole, wherein the heterocyclic compound (a) is a 5-aminotetrazole, the compound (13) is a 2-decyl-1-bromotetradecane and the reaction product is a 1-(2-decyl-1-tetradecanyl)-5-aminotetrazole, or wherein the heterocyclic compound (a) is an imidazole, the compound (b) is a 2-decyl-1-bromotetradecane and the reaction product is a 1-(2-decyl-1-tetradecanyl)-imidazole.

2. The method for producing a lubricant composition according to claim 1, wherein the heterocyclic compound (a) is a 2-aminobenzoimidazole, the compound (b) is a 2-decyl-1-bromotetradecane and the reaction product is a 1-(2-decyl-1-tetradecanyl)-2-aminobenzoimidazole.

3. The method for producing a lubricant composition according to claim 1, wherein the heterocyclic compound (a) is a benzoimidazole, the compound (b) is a 2-decyl-1-bromotetradecane and the reaction product is a 1-(2-decyl-1-tetradecanyl)-benzoimidazole.

4. The method for producing a lubricant composition according to claim 1, wherein the heterocyclic compound (a) is a 5 aminotetrazole, the compound (b) is a 2-decyl-1-bromotetradecane and the reaction product is a 1-(2-decyl-1-tetradecanyl)-5-aminotetrazole.

5. The method for producing a lubricant composition according to claim 1, wherein the heterocyclic compound (a) is an imidazole, the compound (b) is a 2-decyl-1-bromotetradecane and the reaction product is a 1-(2-decyl-1-tetradecanyl)-imidazole.

6. A method for producing a lubricant composition, which comprises:

(1) obtaining a reaction product by reacting one of a heterocyclic compound (a) which is a compound having imidazole or tetrazole as a basic skeleton, or derivatives thereof, with one of compound (b) which is a halogen compound selected from the group consisting of a bromine-based compound, a chlorine-based compound, and an iodine-based compound, said compound having an alkyl group, an alkenyl group, or a cycloalkyl group having a carbon number of 10 to 200, an amine compound, alcohols, an epoxy compound, or a compound having a carboxyl group, at a molar ratio (a):(b) of 1:5 to 5:1;

(2) reacting the reaction product with a boron-containing compound at a molar ratio of the reaction product to the boron-containing compound of 1:0.01 to 1:10 to obtain a second reaction product, and (3) mixing the second reaction product with a lubricant base oil.

* * * * *